US006213629B1

(12) United States Patent
Bringfors

(10) Patent No.: US 6,213,629 B1
(45) Date of Patent: Apr. 10, 2001

(54) DEVICE FOR MIXING FLUE GAS WITH PARTICULATE MATERIAL AND LIQUID

(75) Inventor: Nils Bringfors, Växjö (SE)

(73) Assignee: ABB Fläkt AB

( * ) Notice: Subject to any disclaimer, the term of this patent is extended or adjusted under 35 U.S.C. 154(b) by 0 days.

(21) Appl. No.: 09/398,015

(22) Filed: Sep. 17, 1999

Related U.S. Application Data

(63) Continuation of application No. PCT/SE98/00450, filed on Mar. 13, 1998.

(30) Foreign Application Priority Data

Mar. 17, 1997 (SE) ..... 9700953

(51) Int. Cl.[7] ..... B01F 3/12; B01F 7/10; B01F 13/02

(52) U.S. Cl. ..... 366/103; 366/172.1; 366/194; 366/301; 366/315

(58) Field of Search ..... 366/64, 66, 96–99, 366/101–104, 106, 107, 168.1, 172.1, 172.2, 194–196, 297–301, 315–317

(56) References Cited

U.S. PATENT DOCUMENTS 1,592,231 * 7/1926 Stroder .
3,343,814 * 9/1967 Mund .
3,684,458 * 8/1972 McCammon et al. .
3,761,059 * 9/1973 Rothert et al. .
4,049,240 * 9/1977 Walters, Jr. .
4,064,829 * 12/1977 Hervert ..... 366/107
4,306,815 * 12/1981 Majer et al. ..... 366/102
4,583,842 * 4/1986 Shimono et al. ..... 366/316
4,712,312 * 12/1987 Christodoulou ..... 366/316
5,863,587 * 1/1999 Badertscher et al. ..... 366/316
5,887,973 * 3/1999 Ahman et al. ..... 366/103

FOREIGN PATENT DOCUMENTS

1173787 * 7/1964 (DE) ..... 366/315
1166819 * 7/1985 (JP) ..... 366/317
9616727 6/1996 (WO) .
9843729 10/1998 (WO) .

* cited by examiner

*Primary Examiner*—Charles E. Cooley
(74) *Attorney, Agent, or Firm*—Birch, Stewart, Kolasch & Birch, LLP

(57) ABSTRACT

A device for mixing particulate material and liquid includes a container, an inlet for the introduction of particulate material into the container, a liquid spraying device for spraying liquid over the particulate material in the container, a disc agitator arranged in the container, and an outlet for discharging material mixed with liquid from the container. A fluidization device is provided to fluidize the particulate material in the container during the mixing operation. The inlet is arranged at one lengthwise side wall of the container, so as to extend along that wall. The outlet is arranged in the other lengthwise side wall, so as to extend along the wall.

6 Claims, 3 Drawing Sheets

DEVICE FOR MIXING FLUE GAS WITH PARTICULATE MATERIAL AND LIQUID

This application is a Continuation of PCT International Application No. PCT/SE98/00450 filed on Mar. 13, 1998, which designated the United States and on which priority is claimed under 35 U.S.C. §120, the entire contents of which are hereby incorporated by reference.

BACKGROUND OF THE INVENTION

1. Field of the Invention

This invention concerns a device for mixing particulate material and liquid, and particularly for mixing water and absorbent material which is reactive with gaseous pollutants in flue gases and which, during cleaning of the flue gases, is to be introduced into these gases in a moistened state in order to convert the gaseous pollutants into separable dust, said device comprising an elongate container having two lengthwise side walls and being arranged essentially horizontally in its lengthwise extension, an inlet for the introduction of particulate material into the container, a liquid spraying means for spraying liquid over the particulate material in the container, an agitator in said container, said agitator consisting of at least one rotary shaft which extends in the longitudinal direction of the container and on which are mounted, at an angle, a plurality of axially spaced-apart discs through the centres of which the shaft extends, an outlet for discharging material mixed with liquid from the container, and a fluidizing means adapted to fluidize the particular material in the container during the mixing operation.

2. Description of Background Art

When gaseous pollutants, such as sulphur dioxide, are to be separated from flue gases, the gases are conducted through a contact reactor in which particulate absorbent material reactive with the gaseous pollutants is introduced in a moistened state into the flue gases in order to convert the gaseous pollutants to separable dust. The flue gases are then conducted through a dust separator, in which dust is separated from the flue gases and from which the thus-cleaned flue gases are drawn off. Part of the dust separated in the dust separator is conducted to a mixer, where it is mixed and moistened with water, whereupon it is recycled as absorbent material by being introduced into the flue gases along with an addition of fresh absorbent. Slaked lime (calcium hydroxide) is generally used as the fresh absorbent.

One prior-art device of the kind defined in the introduction is shown in WO 96/16727. The container of the prior-art device has a rear end in which the inlet is located, and a front end in which the outlet is located. When the prior-art device is used as a mixing device in which the above-described mixing of absorbent material and water is performed, the front end of the container is inserted in a flue-gas channel through which the flue gases containing the gaseous pollutants are conducted. The outlet, which thus also is disposed in the flue-gas channel, is an overflow means formed by the lengthwise side walls in the part of the container inserted in the channel being lower than in the container part located outside the channel.

In the WO 96/16727, the prior-art device is disadvantageous because of the projection of the container into the flue-gas channel, which may cause disturbance of the gas flow therein and make it difficult to obtain an even distribution of moistened material across the channel cross-section, particularly in the case of large cross-sectional areas.

SUMMARY AND OBJECTS OF THE INVENTION

The object of the present invention thus is to provide a device which is particularly adapted for use in mixing absorbent material and water in the above-described flue-gas cleaning operation, and in which the above disadvantages are eliminated, or at least considerably reduced.

This object is obtained in accordance with the invention by means of a device of the kind defined in the introduction and which includes an inlet that is located at one lengthwise side wall of the container and extends along said wall, and that the outlet which is an essentially horizontal overflow means, is located in the other lengthwise side wall of the container and extends along said other wall.

In certain applications, it is advantageous to arrange the container at such an angle to its longitudinal axis that it slopes downwardly, towards the outlet, In accordance with one preferred embodiment, a plurality of obliquely downwardly extending distribution plates formed with two side edges that converge downwardly in the direction of inclination, are disposed at the outlet in order to receive material mixed with liquid on their upper faces.

Preferably, the container has an upper bottom and a lower bottom, said upper and lower bottoms defining between them a chamber and the upper one of said bottoms being air-permeable, an air-supply means being arranged to supply air to the chamber for the purpose of fluidizing the particulate material in the container.

Preferably, the discs have an elliptic shape and are so inclined about their minor axes relative to the shafts as to have a circular axial projection.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
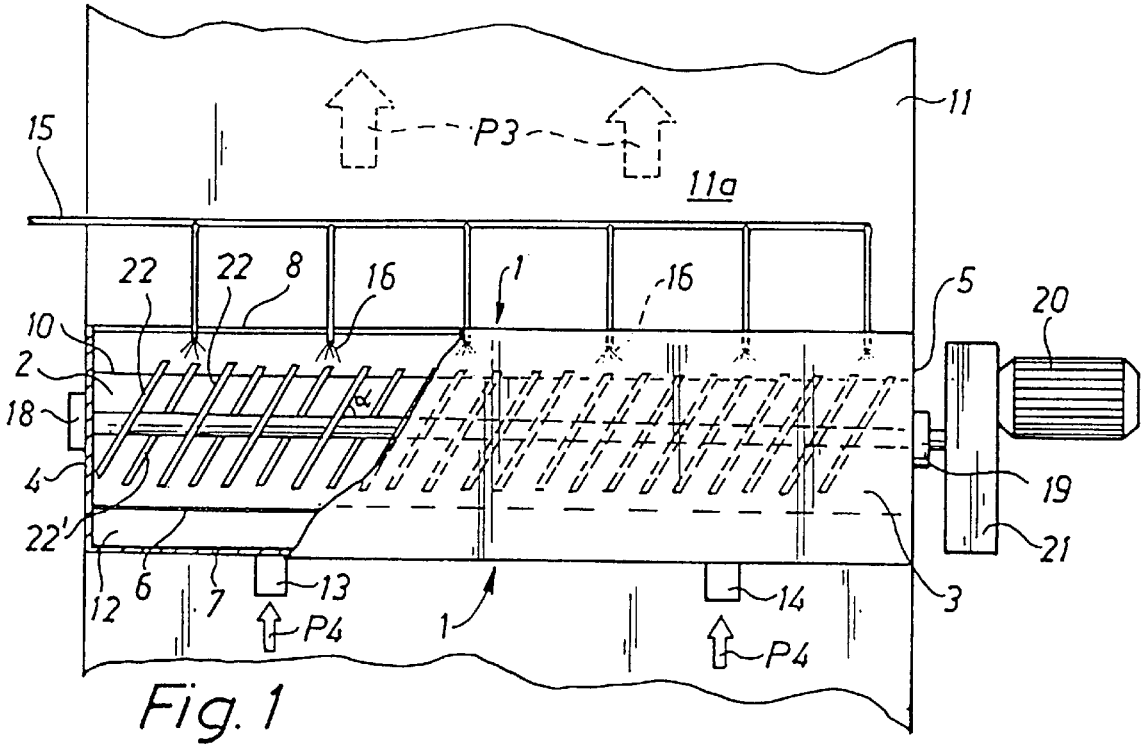
FIG. 1 is a side view which schematically illustrates a device according to the invention, but in which certain parts of the device have been broken away.
Figure 2:
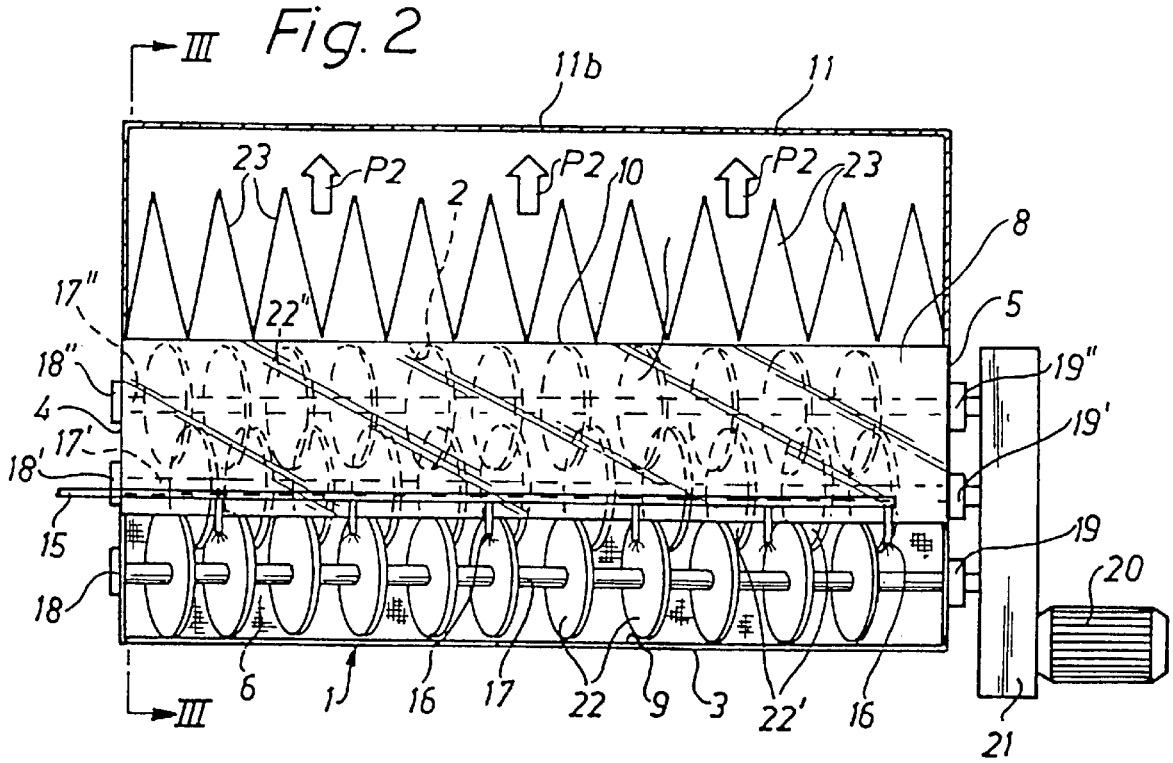
FIG. 2 is a top view of the device in FIG. 1.
Figure 3:
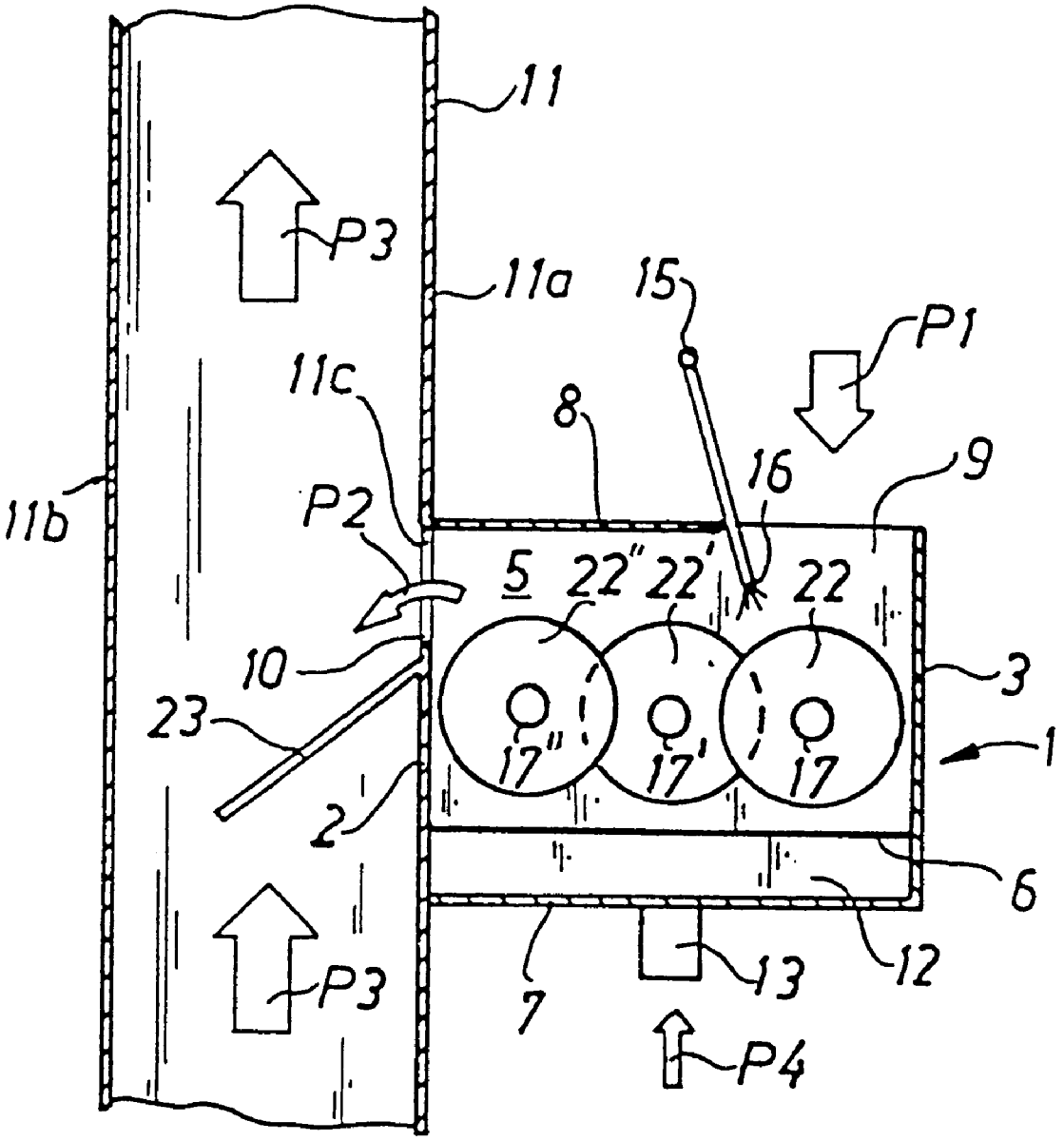
FIG. 3 is a cross-section taken along line III—III in FIG. 2.

The mixing device illustrated in the FIGS. 1–3 comprises a container 1, which essentially is in the shape of an elongate, parallelepidal box. The container 1 has two vertical lengthwise side walls 2 and 3, two end walls 4 and 5, a horizontal upper bottom 6, a horizontal lower bottom 7 and a horizontal top 8.

At the one of its lengthwise side walls, the container 1 has an inlet 9, through which particulate material is supplied into the container 1 from above (arrow P1 in FIG. 3) and at its other lengthwise side wall, the container 1 has an outlet 10, through which is discharged a homogeneous mixture of particulate material and water (arrows P2 in FIGS. 2 and 3). The inlet 9 and the outlet 10 extend along the entire length of the container 1. In accordance with the shown embodiment, the inlet 9 is an elongate hole formed in the top 10, said hole preferably being encircled by a peripheral collar (not shown). In accordance with the shown embodiment, the outlet 10 is an overflow means, said means formed by disposing the lengthwise side wall 2 at a lower level than the other walls 3, 4 and 5.

The container 1 illustrated in the drawings is located adjacent a vertical flue-gas channel 11 through which flue gases containing gaseous pollutants, such as sulphur dioxide, are conducted upwards (arrows P3 in FIGS. 1 and 3) in order to be cleaned in a known fashion. In the shown embodiment, the flue-gas channel 11 has a rectangular cross-sectional configuration. The lengthwise side wall 2 of the container 1, which wall has a length essentially equalling that of the wide side walls 11*a*, 11*b* of the channel 11, abuts against one 11*a* of said side walls. The top 8 of the container 1 extends, as appears from FIGS. 2 and 3, from the inlet 9 to the outlet 10, i.e. to the side wall 11*a* of the flue-gas channel 11. The side wall 11*a* is formed with a rectangular opening 11*c*, the shape and dimensions of which essentially equal those of the outlet slot defined between the top 8 and the upper edge of the lengthwise side wall 2, and which is placed in opposite relationship to said slot.

Between them, the two bottoms 6 and 7 define a chamber 12 which, in the lateral direction, is delimited by the two lengthwise side walls 2 and 3 and, in the longitudinal direction, is delimited by the two end walls 4 and 5. The ceiling of the chamber 12, i.e. the upper bottom 6, consists of an air-permeable fluidization cloth of polyester mounted in a stretched state in the container 1. An air-supply means, which in accordance with the shown embodiment consists of two air inlets 13 and 14, is arranged to supply air to the chamber 12 (arrows P4 in FIGS. 1 and 3), so as to fluidize the particulate material in the container 1.

A water-supply line 15, which is disposed above the container 1, is connected to a plurality of nozzles 16 arranged in the upper part of the container 1 to spray water in a finely-divided form over the particulate material in the container. The nozzles 16, of which bat a few are shown in the drawings, are arranged in a row extending along the container 1 adjacent the inlet 9.

Three juxtaposed, horizontal shafts 17, 17', 17" extend along the entire length of the container 1 and are rotatably mounted in the two end walls 4 and 5 with the aid of bearings 18, 18', 18" and 19, 19', 19", respectively. A motor 20 is arranged to rotate the shafts 17, 17', 17" via a transmission unit 21.

Each shaft 17, 17', 17" supports a plurality of elliptic discs 22, 22', 22", said discs being mounted in an axially spaced-apart relationship on the shafts 17, 17', 17", respectively, and so as to be inclined about their minor axes. The shafts 17, 17', 17" extend through the centres of the respective discs 22, 22', 22". In the example illustrated, each disc 22, 22', 22" is so inclined in relation to the shaft 17, 17', 17" that the angle $\alpha$ between the major axis of the disc and the shaft 17, 17', 17" is about 60° (see FIG. 1). This angle $\alpha$ may vary between 45° and 80°. The discs 22, 22', 22" are so inclined in relation to the respective shafts 17, 17', 17" and have such an elliptic shave as to have a circular axial projection, as illustrated in FIG. 3. The discs 22, 22', 22" are so positioned on the respective shafts 17, 17', 17" that the discs on one shaft project into the spaces between the discs on the neighbouring shaft or shafts.

As the shafts 17, 17', 17" rotate, each disc 22, 22', 22" arranged and designed in the manner indicated above performs a throwing movement conducive to thorough mixing of particulate material.

In order to facilitate discharge of the particulate material mixture, the container 1 may be disposed at such an angle to its longitudinal axis that it slopes downwards in the direction towards the outlet 10.

The flue-gas channel 11 illustrated in the drawing forms part of a system for cleaning flue gases containing gaseous pollutants, such as sulphur dioxide. The flue gases (P3) are passed through the flue-gas channel 11, in which particulate absorbent material reactive with the gaseous pollutants is introduced into the flue gases in a moistened state in order to convert the gaseous pollutants into separable dust. The flue gases are then passed through a dust separator (not shown), in which dust is separated from the flue gases and from which the thus-cleaned flue gases are discharged into the surrounding atmosphere. Part of the dust separated in the dust separator, along with an addition of fresh absorbent, e.g. in the form of particles of burnt lime, is supplied as particulate material (P1) to the inlet 9 of the container 1, so as to be mixed in the container with water sprayed over the particulate material in the container through the nozzles 16. The particulate material in the container 1 is maintained in fluidized state by means of air (P4) which is introduced into the container via the air inlets 13 and 14, the chamber 12 and the fluidization cloth 6. As a result of this fluidization as well as the rotation of the shafts 17, 17', 17" one obtains a homogeneously moistened, homogeneous mixture of the particulate material, this mixture being supplied to the flue-gas channel 11 as said absorbent material (P2) via the overflow means 10.

For the purpose of improving the distribution across the whole cross-sectional area of the flue-gas channel 11, of the homogeneously moistened, homogeneous mixture discharged via the outlet 10, the container 1 is equipped with a plurality of flat distributing plates 23, each one of which is configured as an isosceles triangle. The plates 23 are attached at their bases to the lengthwise side wall 2 of the container 1, at the upper edge of said wall, i.e. at the overflow, and extend obliquely downwards into the flue-gas channel 11 via the opening 11*c* formed in the channel wall 11*a* so as to receive the discharged mixture on their upper faces and distribute it across the channel cross-sectional area.

Figure 4:
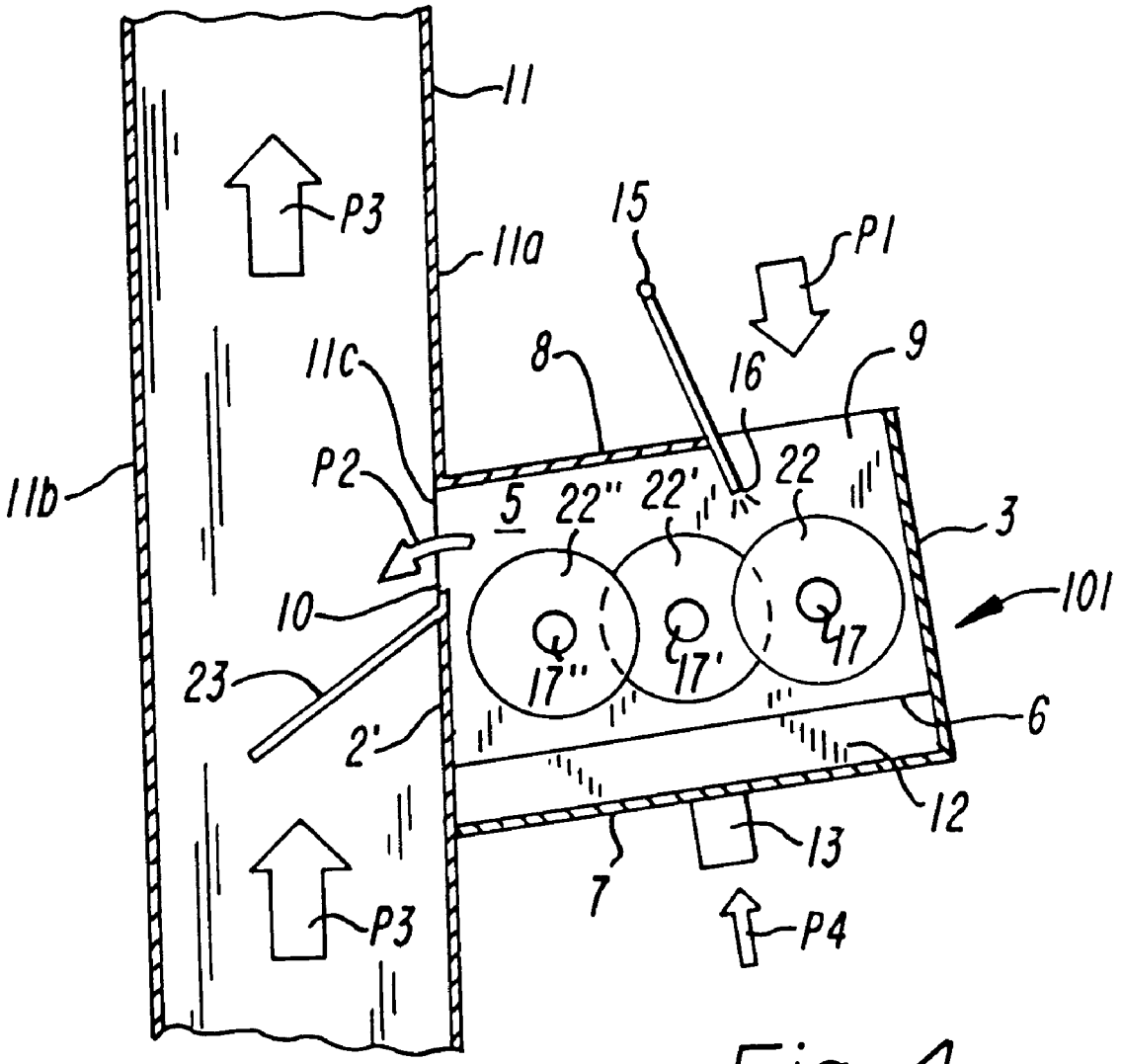
FIG. 4 is a cross-sectional view illustrating the container being at an angle relative to the outlet.

FIG. 4 is a cross-sectional view wherein the container 101 is illustrated as being disposed at an angle relative to the outlet 10. All of the other features illustrated in FIG. 4 are similar to the features illustrated in FIG. 3 and will not be described further.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A device for mixing particulate material and liquid with gaseous pollutants in flue gases for cleaning of the flue gases wherein the particulate material and liquid is introduced into the flue gases in a moistened state in order to convert the gaseous pollutants into separable dust, said device comprising;

an elongate container having two lengthwise side walls and being arranged essentially horizontally in its lengthwise extension;

an inlet for the introduction of particulate material into the container;

a liquid spraying means for spraying liquid over the particulate material in the container;

an agitator in said container, said agitator comprising at least one rotary shaft extending in the longitudinal direction of the container and on which are mounted, at an angle, a plurality of axially spaced-apart discs through the centers of which the shaft extends;

an outlet for discharging material mixed with liquid from the container; and a fluidizing means adapted to fluidize the particular material in the container during the mixing operation, wherein the inlet is located at one lengthwise side wall of the container and extends along said wall, and that the outlet is an essentially horizontal overflow means located in the other lengthwise side wall of the container and extends along said other wall.

2. A device as claimed in claim 1, wherein the container is positioned at an angle to its longitudinal axis to slope downwardly towards the outlet.

3. A device as claimed in claim 1, and further including a plurality of obliquely downwardly extending distribution plates formed with two side edges that converge downwardly in the direction of inclination disposed at the outlet in order to receive material mixed with liquid on their upper faces.

4. A device as claimed in claim 1, wherein the container has an upper bottom and a lower bottom, said upper and lower bottoms defining between them a chamber and the upper one of said bottoms being air-permeable, an air-supple means being arranged to supply air to the chamber for the purpose of fluidizing the particulate material in the container.

5. A device as claimed in claim 1, wherein the discs have an elliptic shape and are inclined about their minor axes relative to the shafts to have a circular axial projection.

6. A device as claimed in claim 1, wherein the particulate material is an absorbent material for reacting with the gaseous pollutants in the flue gases and the liquid is water.

* * * * *